US008595968B2

(12) United States Patent
Byfield

(10) Patent No.: US 8,595,968 B2
(45) Date of Patent: Dec. 3, 2013

(54) SYSTEMS AND METHODS FOR PROVIDING AN ACCESSORIZABLE FRAME SYSTEM

(76) Inventor: Richard E. Byfield, Brandon (CA)

( * ) Notice: Subject to any disclaimer, the term of this patent is extended or adjusted under 35 U.S.C. 154(b) by 933 days.

(21) Appl. No.: 12/724,213

(22) Filed: Mar. 15, 2010

(65) Prior Publication Data

US 2010/0229441 A1 Sep. 16, 2010

Related U.S. Application Data

(60) Provisional application No. 61/160,570, filed on Mar. 16, 2009.

(51) Int. Cl.
*A47G 1/06* (2006.01)

(52) U.S. Cl.
USPC ..... 40/732; 40/743; 40/781; 40/772

(58) Field of Classification Search
USPC ..... 40/700, 732, 743, 769, 781, 772
See application file for complete search history.

(56) References Cited

U.S. PATENT DOCUMENTS

| | | | | |
|---|---|---|---|---|
| 156,788 | A | | 11/1874 | Hale |
| 1,463,150 | A | | 7/1923 | Carlsen |
| 2,125,191 | A | | 7/1938 | Moore |
| 2,314,721 | A | | 3/1943 | Lowenstein |
| 2,598,755 | A | | 6/1952 | Birch |
| 3,339,302 | A | | 9/1967 | Mallory |
| 3,371,439 | A | | 3/1968 | Smith et al. |
| 3,382,595 | A | | 5/1968 | Shore |
| 3,523,382 | A | | 8/1970 | Dreyer |
| 3,579,886 | A | * | 5/1971 | Hughes ..... 40/773 |
| 3,607,587 | A | | 9/1971 | Langkopf |
| 4,034,496 | A | | 7/1977 | Cohen |
| 4,115,938 | A | | 9/1978 | Belmuth et al. |
| 4,117,613 | A | | 10/1978 | Hosker |
| 4,215,499 | A | | 8/1980 | Wilson |
| 4,244,127 | A | | 1/1981 | Buzzard |
| 4,261,122 | A | | 4/1981 | LeVine |
| 4,286,400 | A | | 9/1981 | MacPherson et al. |
| 4,590,696 | A | | 5/1986 | Squitieri |
| 4,608,770 | A | | 9/1986 | Gray |
| 4,706,397 | A | | 11/1987 | Hesener |
| 4,777,745 | A | | 10/1988 | Rose |
| 4,794,714 | A | | 1/1989 | Weisgerber |
| 4,991,336 | A | | 2/1991 | Lucke |
| 5,025,579 | A | | 6/1991 | Krueger |
| 5,057,344 | A | | 10/1991 | Mealey |
| 5,077,921 | A | | 1/1992 | Mooney |
| 5,174,054 | A | | 12/1992 | Politi |
| 5,230,172 | A | | 7/1993 | Hsu |

(Continued)

FOREIGN PATENT DOCUMENTS

WO WO 2007/008865 A2 1/2007

*Primary Examiner* — Gary Hoge
(74) *Attorney, Agent, or Firm* — David B. Tingey; Kirton | McConkie

(57) ABSTRACT

Systems and methods for producing an accessorizable frame system comprising a display plate, a frame plate, and an attachment, which selectively and releaseably holds the display plate away from the frame plate, are disclosed. In some cases, the attachment that connects the display plate to the frame plate includes a clip that extends from the display plate and which is configured to be received in a corresponding opening within the frame plate. In some instances, to accessorize the frame system, a user adds an aligner, a liner, a back cover, and/or any other suitable component to the frame system.

20 Claims, 11 Drawing Sheets

(56) References Cited

U.S. PATENT DOCUMENTS

| | | | | | |
|---|---|---|---|---|---|
| 5,267,403 | A | | 12/1993 | Hesner | |
| 5,323,552 | A | | 6/1994 | Fritz | |
| 5,383,293 | A | | 1/1995 | Royal | |
| 5,419,589 | A | | 5/1995 | Fattore | |
| 5,483,762 | A | | 1/1996 | Hogan | |
| 5,588,240 | A | | 12/1996 | Zilliox | |
| 5,659,991 | A | | 8/1997 | Kennedy | |
| 5,787,626 | A | | 8/1998 | Bingham et al. | |
| 5,806,223 | A | | 9/1998 | Visagie | |
| 5,896,690 | A | | 4/1999 | Suesholtz | |
| 5,918,398 | A | | 7/1999 | Stanley et al. | |
| 5,943,801 | A | | 8/1999 | Wilkinson | |
| 5,950,342 | A | * | 9/1999 | Suesholtz | 40/768 |
| 6,054,968 | A | | 4/2000 | De Matteo | |
| 6,067,738 | A | * | 5/2000 | Zeligson | 40/606.03 |
| 6,205,692 | B1 | * | 3/2001 | Kite | 40/615 |
| 6,209,248 | B1 | | 4/2001 | Reinhard | |
| 6,305,112 | B1 | | 10/2001 | Hansen | |
| 6,338,215 | B1 | | 1/2002 | Vincent | |
| 6,347,467 | B1 | | 2/2002 | Meyer | |
| 6,447,079 | B1 | | 9/2002 | Irwin | |
| 6,640,476 | B1 | * | 11/2003 | Miller | 40/560 |
| 6,655,064 | B1 | | 12/2003 | Dodson | |
| 6,684,545 | B2 | * | 2/2004 | Wohlleb | 40/732 |
| 6,962,016 | B1 | | 11/2005 | Meyer | |
| 2002/0059745 | A1 | | 5/2002 | Vincent | |
| 2002/0078583 | A1 | | 6/2002 | Richardson | |
| 2003/0056413 | A1 | | 3/2003 | Wiemer et al. | |
| 2003/0196364 | A1 | * | 10/2003 | Chang | 40/732 |
| 2005/0044767 | A1 | * | 3/2005 | Lasher | 40/757 |
| 2006/0196095 | A1 | | 9/2006 | Flannigan | |
| 2007/0258159 | A1 | | 11/2007 | Driessen | |
| 2009/0113776 | A1 | * | 5/2009 | Van Bortel | 40/781 |

* cited by examiner

SYSTEMS AND METHODS FOR PROVIDING AN ACCESSORIZABLE FRAME SYSTEM

CROSS-REFERENCE TO RELATED APPLICATIONS

This application claims priority to U.S. Provisional Application No. 61/160,570, filed Mar. 16, 2009, entitled "Systems and Methods for Providing an Accessorizable Frame System," the entire disclosure of which is hereby incorporated by reference.

BACKGROUND OF THE INVENTION

1. Field of the Invention

The present application relates to picture frames. In particular, the present invention provides systems and methods for providing an accessorizable frame system having a plurality of pieces that selectively connect to and disconnect from each other. Because certain pieces in the frame system can easily be connected to and disconnected from each other, the frame system is easily assembled, customized, and otherwise used to provide an aesthetically pleasing display.

2. Background and Related Art

Frames, such as picture frames, are known devices that are used to hold and display pictures, paintings, artwork, certificates, and the like. Conventional picture frames are available with a large variety of characteristics. In some typical implementations, however, picture frames comprise an outer square or rectangular frame, a backing, and/or a flat piece of glass or transparent plastic. In such implementations, artwork, or another object being displayed, is often sandwiched between the backing and the piece of glass (or a retaining lip in the frame if the glass/plastic covering is not present).

While conventional picture frames have proven useful as a means for holding and displaying certain objects, some conventional picture frames still have some shortcomings. In one example, some picture frames are not easily customizable or accessorizable. Accordingly, such picture frames can have a static appearance—as opposed to a dynamic appearance that can easily be changed for a variety of uses. In another example, some picture frames require tools for assembly or for hanging. In still another example, certain picture frames require a relatively high level of skill to properly align a picture within the frame. In yet another example, some picture frames can be expensive to manufacture.

Thus, while techniques currently exist that are used to frame and display pictures, paintings, and other artwork, challenges still exist, including those mentioned above. Accordingly, it would be an improvement in the art to augment or even replace current techniques with other techniques.

SUMMARY OF THE INVENTION

The present application relates to picture frames. In particular, the present invention provides systems and methods for providing an accessorizable frame system having a plurality of pieces that selectively connect to and disconnect from each other. Because certain pieces in the frame system can be connected to and disconnected from each other, the frame system is easily assembled, customized, and otherwise used to provide an aesthetically pleasing display.

Although the frame system can comprise any suitable component, in some implementations, the frame system includes a display plate and a frame plate. In such implementations, the display plate and the frame plate can have any suitable characteristic that allows them to function as intended. In one non-limiting example, the display plate comprises a first side and a second side, wherein the first side comprises a substantially flat display surface. Similarly, in another non-limiting example, the frame plate comprises a front side and a back side, wherein the back side comprises at least one receptacle for a connector, or a component that can support the frame system against a substrate (e.g., a wall, desk, refrigerator, a back cover, etc.). In still another non-limiting example, the frame plate has a larger perimeter than does the display plate. Accordingly, when the two plates are connected, at least a portion of the frame plate extends laterally past the display plate's perimeter.

The frame plate and the display plate can be connected to each other in any suitable manner that allows the two components to be selectively connected to, and releasably disconnected from, each other. In one non-limiting example, at least one clip extends from the display plate's second side and the frame plate comprises at least one receptacle that is sized and shaped to receive the clip.

In addition to the aforementioned components, the frame system can comprise any other suitable component, including, but are not limited to, an aligner, a liner, and/or a back cover. In such instances, the various components may serve any suitable purpose. By way of non-limiting example, the aligner can help a user to properly align a piece of artwork on the display plate. In another non-limiting example, the liner can be used to provide additional color, contrast, and/or another desired characteristic to the frame system. In still another non-limiting example, the back cover can cover the frame plate's back side and provide the frame system with a leg that allows the frame system to stand on its own.

While the systems and methods of the present invention have proven to be particularly useful in the area of framing photographs, awards, papers, certificates, paintings, drawings, artwork, silk screens, applied graphics, and other objects, those skilled in the art can appreciate that the described systems and methods can be used in a variety of different applications and in a variety of different areas of manufacture. By way of non-limiting example, the described frame system can also be used to display trophies, knick knacks, memorabilia, and other 3-dimensional objects.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present application relates to picture frames. In particular, the present invention provides systems and methods for providing an accessorizable frame system having a plurality of pieces that selectively connect to, and disconnect from, each other. Because certain pieces in the frame system can easily be connected to and disconnected from each other, the frame system is easily assembled, customized, and otherwise used to provide an aesthetically pleasing display.

In the disclosure and in the claims, the term display media, and variations thereof (e.g., display medium, medium, and media) may refer to any suitable object that can be placed on or in the frame system for display. Some examples of suitable display media include, but are not limited to, one or more photographs, certificates, pictures, drawings, paintings, canvases, applied graphics, silk screens, papers, awards, memorabilia, knick knacks, medals, trophies, keepsakes, and other suitable items.

Figure 1A:
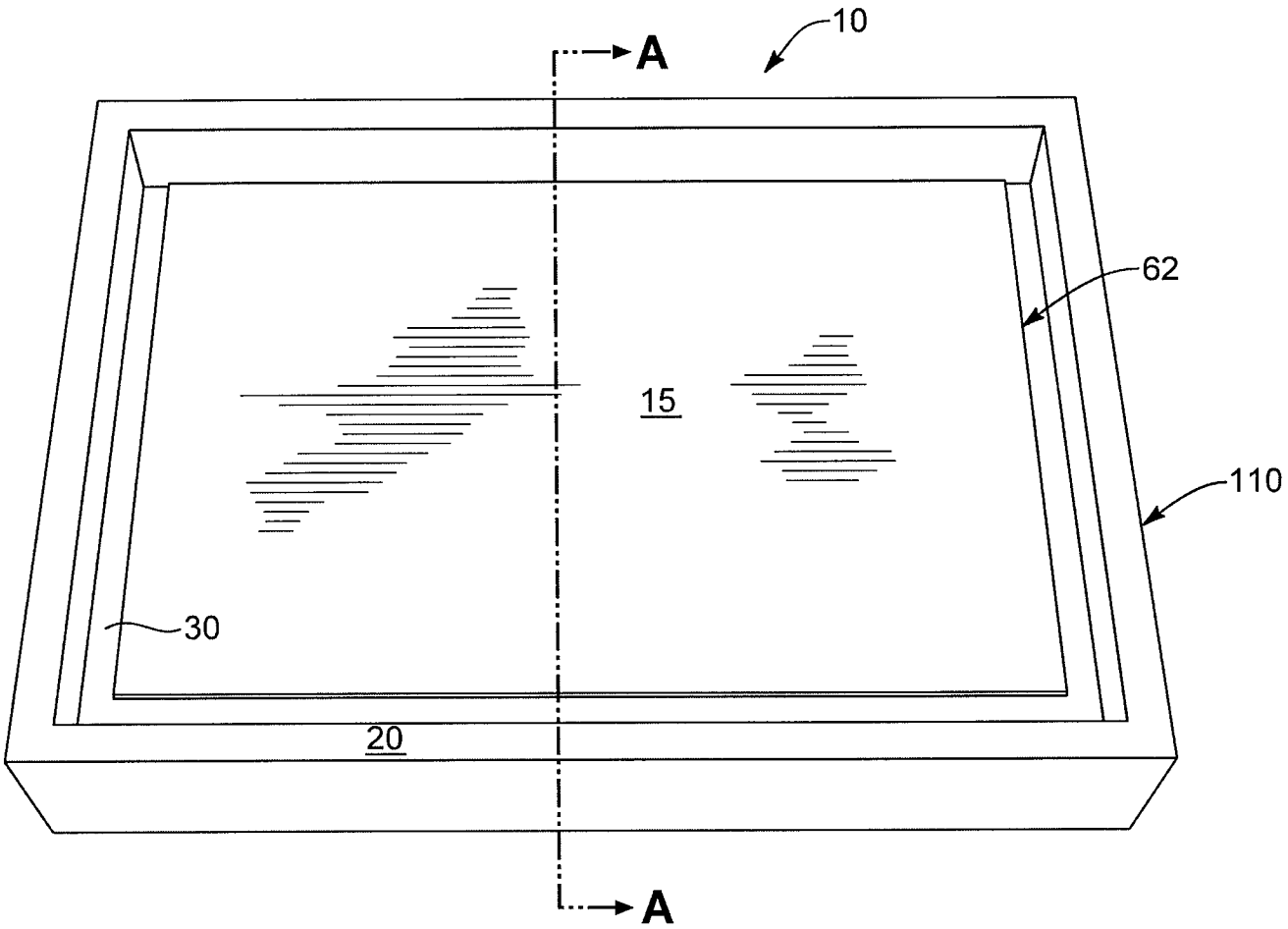
FIG. 1 illustrates a perspective view of a representative embodiment of a frame system.
FIG. 1B illustrates a cross-sectional, exploded view of the frame system of FIG. 1, cut along line A-A.
FIG. 1C illustrates a cross-sectional view of the assembled frame system illustrated in FIG. 1, cut along line A-A.
Figure 1C:
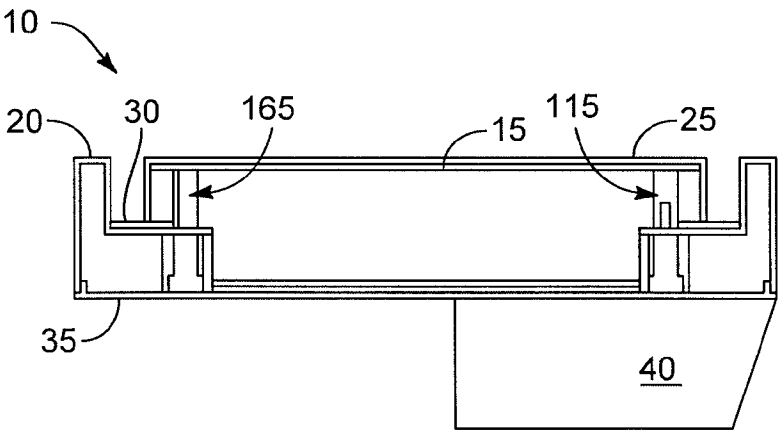
Figure 1B:
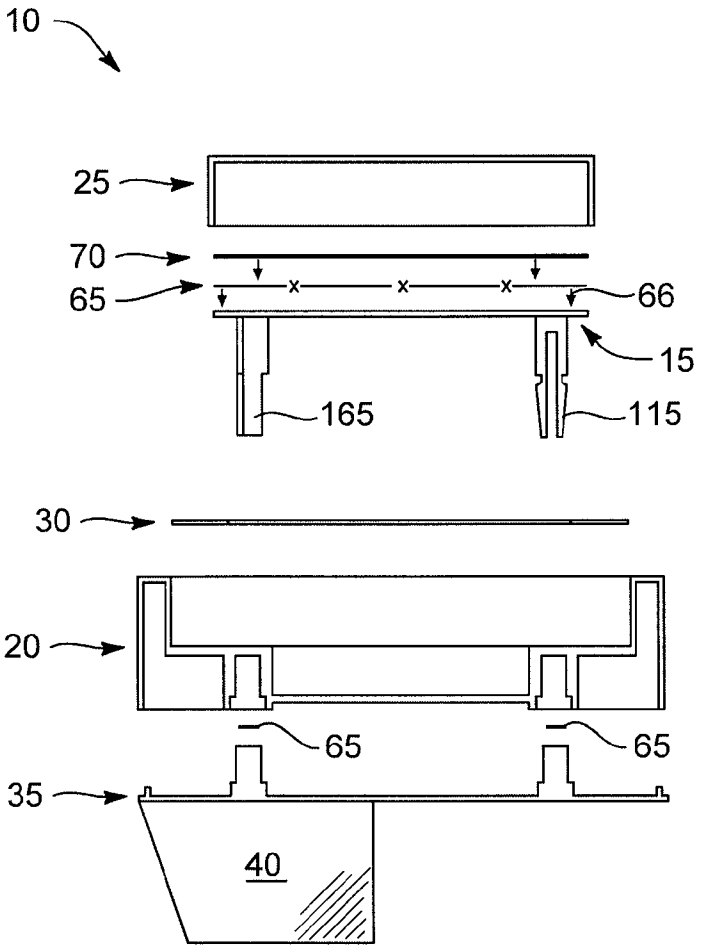

The described frame system can comprise virtually any component that allows the system to frame one or more display media while allowing a plurality of components in the frame system to be selectively connected to, and disconnected from, each other. By way of non-limiting example, FIG. 1A illustrates a representative embodiment in which an assembled frame system 10 comprises a display plate 15 and frame plate 20. Additionally, FIGS. 1B and 1C illustrate different views of a non-limiting embodiment in which the frame system 10 optionally comprises an aligner 25, a liner 30, a back cover 35, and/or one or more legs 40. To provide a better understanding of the frame system, each of the aforementioned components is described below in more detail.

Figure 2B:
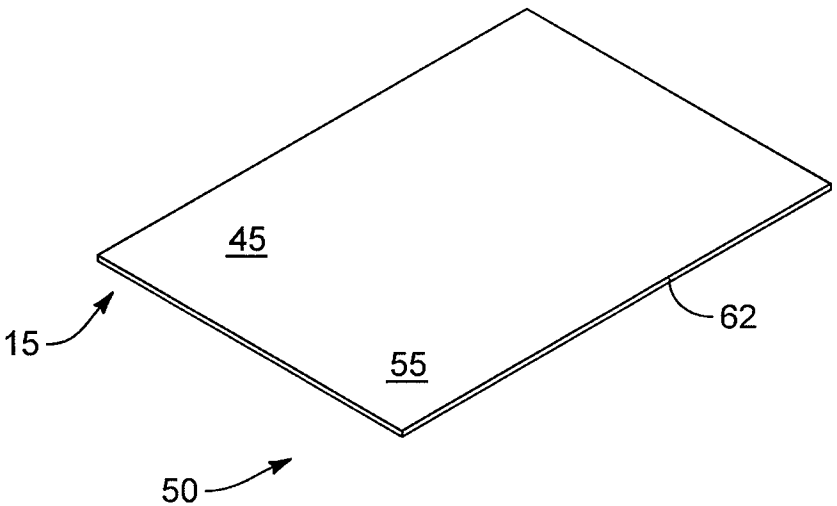
FIG. 2B illustrates a perspective view of a display surface of the display plate of FIG. 2A.
Figure 2A:
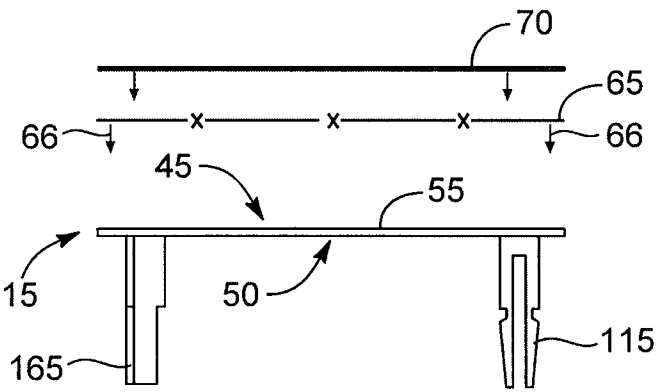
FIG. 2A illustrates a side-plan view of a representative embodiment of a display plate.

With respect to the display plate 15, the display plate can have any suitable characteristic that allows it to hold one or more display media and to connect the display media to the frame plate 20. In this regard, FIGS. 2A and 2B illustrate different views of a non-limiting embodiment in which the display plate 15 comprises a first side 45 (or a display media attachment side) and a second side 50 (which optionally comprises an attachment for connecting the display plate to the frame plate, as hereinafter described). In such an embodiment, the display plate's first side and second side can have any suitable characteristic that allows the display plate to function as intended. Indeed, in one non-limiting example, FIGS. 2A and 2B show the display plate's first side 45 comprises a substantially flat display surface 55 that is capable of supporting a picture, a painting, a photograph, painting, drawing, or any other suitable display media (not shown in FIG. 2A or 2B).

Figure 2D:
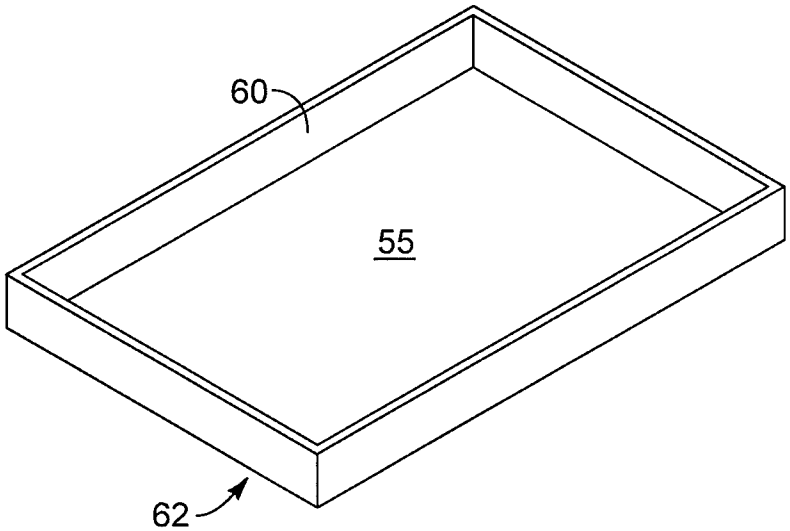
FIG. 2D illustrates a perspective view of the display plate of FIG. 2C.
Figure 2C:
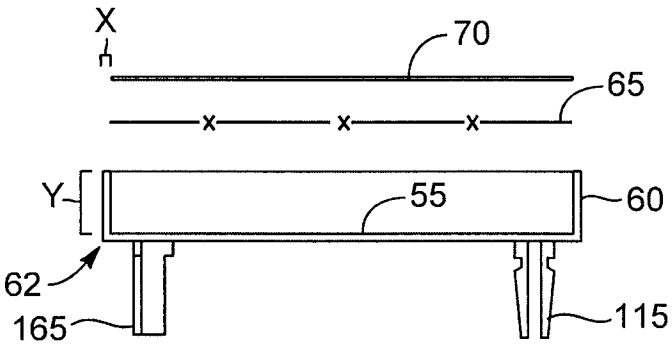
FIG. 2C illustrates a cross-sectional view of a representative embodiment of the display plate comprising a raised edge that allows the display plate to function as a shadow box.

In another non-limiting example, FIGS. 2C and 2D show different views of an embodiment in which the display plate 15 comprises one or more raised edges 60 around its perimeter 62 that extend proximally away from the display surface 55 so the display surface 55 is recessed within the raised edges 60. While the raised edges may serve any suitable function, in some instances, the raised edges allow the display plate to be a shadow box in which any suitable medals, memorabilia, knick knacks, or other suitable display media can be placed. In this regard, in some embodiments where the display plate comprises a shadow box, the display plate holds thicker display media than would be possible in some other embodiments in which the display plate does not comprise one or more raised edges.

Where the display plate 15 comprises one or more raised edges 60, the raised edges can have any suitable characteristic. In one non-limiting example, the raised edges 60 have any suitable thickness X (as shown in FIG. 2C). In another non-limiting example, the raised edges 60 are raised any suitable distance Y (as shown in FIG. 2C) from the display surface 55. Indeed, in some non-limiting embodiments, the raised edges extend more than: about 2.5 millimeters (about 0.1 inches), about 0.5 centimeters (about 0.2 inches), or about 1 centimeter (about 0.4 inches) above the display surface. Similarly, in some non-limiting embodiments, the raised edges extend less than: about 10 centimeters (about 4 inches), about 5 centimeters (about 2 inches), or about 2.5 centimeters (about 1 inch) above the display surface. Indeed, in some presently preferred embodiments, the rails extend between about 0.64 centimeters (about 0.25 inches) and about 1.3 centimeters (about 0.5 inches) past the display surface.

In some non-limiting embodiments, the display plate 15 optionally comprises a mechanism for securing a display medium to the display surface 55. In such embodiments, the display plate can comprise any suitable securing mechanism, including, without limitation, an adhesive, a clamping mechanism, and/or any other suitable means for attaching display media to the display plate. By way of non-limiting example, FIG. 2A (see also FIGS. 1B and 2A) shows an embodiment in which a sheet a double-sided-adhesive contact paper 65 can be connected to the display surface (as illustrated by arrows 66) to secure a display medium 70 to the display plate 15.

Figure 3B:
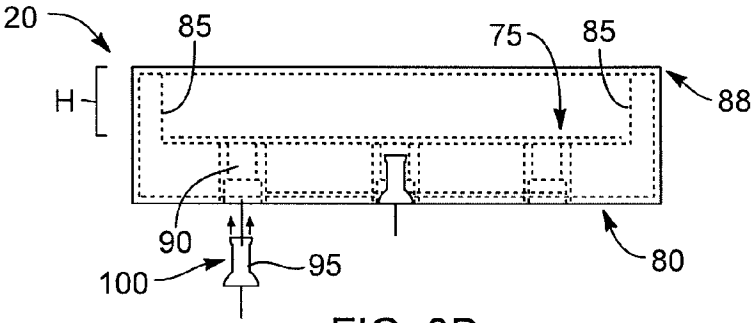
FIG. 3B illustrates a cross-sectional view of the frame plate of FIG. 3A, cut along line C-C.
Figure 3D:
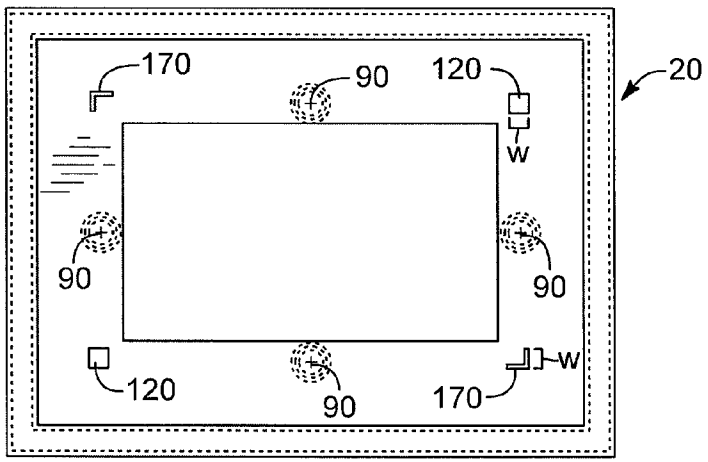
FIG. 3D illustrates a top schematic view of a representative embodiment of the frame plate.
Figure 3A:
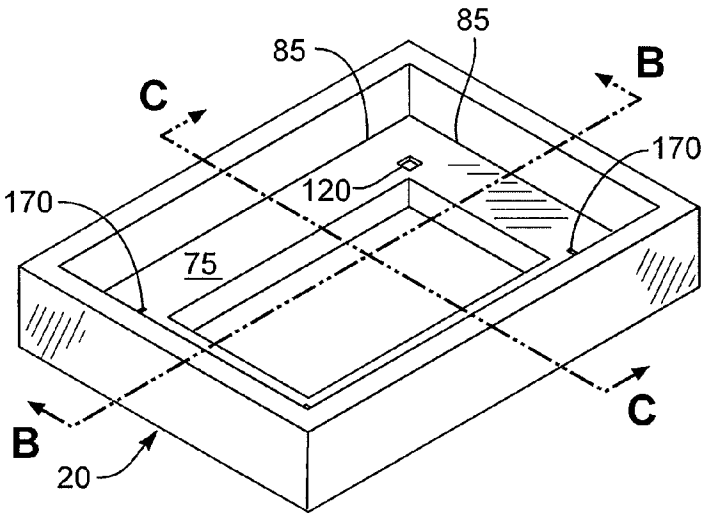
FIG. 3A illustrates a perspective view of a representative embodiment of a frame plate.

With respect to the frame plate 20, the frame plate can comprise any suitable component that allows its outermost perimeter to extend past and form a border around at least a portion of the display plate's perimeter 62. Indeed, in one non-limiting example, FIG. 1A shows the frame plate's outermost perimeter 110 is larger than the display plate's perimeter 62. In another non-limiting example, FIGS. 3A and 3B show different views of an embodiment in which the frame plate 20 comprises a front side 75 and a back side 80.

In still another non-limiting example, at least a portion of the frame plate 20 optionally extends proximally past the frame plate's front side 75 to create a shadow box presentation around the display plate 15 when the display plate is connected to the frame plate. While any suitable portion of the frame plate can be raised proximally past the frame plate's front side 75, FIGS. 3A and 3B show that, in some non-limiting embodiments, the frame plate is raised at a plurality of perimeters 85.

Where the frame plate 20 comprises one or more raised perimeters 85, the raised perimeters can have any suitable characteristic. In one non-limiting example, the raised perimeters are raised any suitable or desired height H (as shown in FIG. 3B) above the frame plate's front side 75. In another non-limiting example, the raised perimeters 85 have any suitable thickness T (as illustrated in FIG. 3B). In still another non-limiting example, the proximal end 88 of the raised perimeters (as shown in FIG. 3B) has any suitable shape, including, but not limited to a square (as shown in FIG. 3B), a triangular, stepped, rounded, irregular, or any other suitable shape that decorates the frame plate.

Figure 3E:
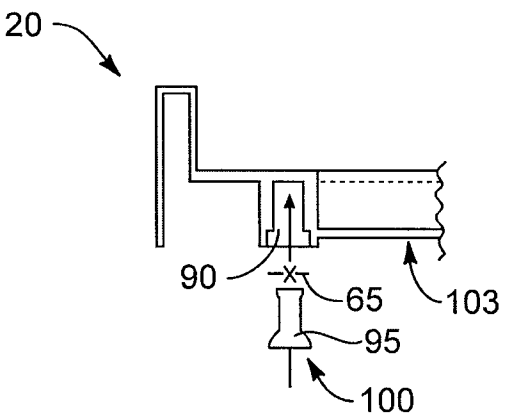
FIG. 3E illustrates a portion of the frame plate from FIG. 3C, illustrating a representative embodiment of a receptacle capable of receiving a push pin.
Figure 3C:
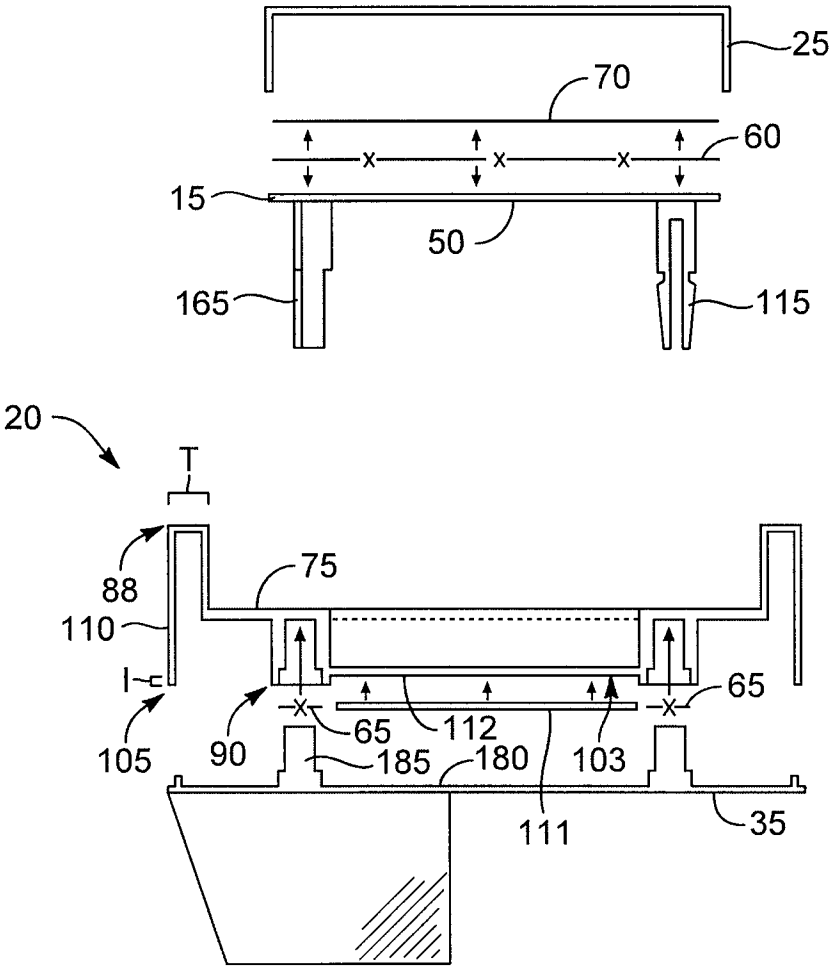
FIG. 3C illustrates a cross-sectional, exploded view of the frame system illustrated in FIG. 1, cut along line A-A.

In some non-limiting embodiments, the back side 80 of the frame plate 20 comprises one or more receptacles for receiving a connector that is capable of connecting the frame plate to a supporting object. As used herein, the term supporting object may refer to any suitable object that is capable of holding the frame system. Some non-limiting examples of suitable supporting objects include a wall (e.g., a wall comprising a fabric surface, a gypsum board (such as sheet rock), a cork board, etc.), a metal object (e.g., a refrigerator, a file cabinet, a shelf system, etc.), the back cover, and so forth. Additionally, as used herein, the term connector may refer to any suitable connecting mechanism that is capable of connecting the frame plate to a supporting object. Non-limiting examples of suitable connectors comprise one or more push-pins, pieces of hook-and-loop fastener, magnets, adhesives, slots for fasteners (e.g., nails, screws, etc.), and any other suitable component that can attach the frame system to a supporting object.

Where the frame plate's back side 80 comprises a receptacle for receiving a connector, the frame plate can comprise any suitable receptacle. In one non-limiting example, FIGS. 3B and 3C show different views of an embodiment in which frame plate's back side 80 comprises a plurality of push-pin receptacles 90 that are each sized and shaped to receive the handle 95 of a push-pin 100. With push-pins disposed on the frame plate's back side, the frame plate can be connected to a supporting object by placing the frame in a desired position on a supporting object (e.g., a gypsum wall) and forcing the push-pins' point into the supporting object.

Where the frame plate's back side 80 comprises a push-pin receptacle, the back side can comprise any suitable number of push-pin receptacles, including, without limitation, 1, 2, 3, 4, 5, 6, or more. By way of illustration, FIG. 3D shows a non-limiting embodiment in which the frame plate 20 comprises 4 push-pin receptacles 90 (as illustrated by the dashed lines).

Where the frame plate's back side 80 comprises one or more push-pin receptacles 90, a push-pin 100 can be anchored within each receptacle in any suitable manner, including, without limitation through the use of an adhesive or a frictional engagement. According to at least some presently preferred embodiments, however, FIG. 3E shows that an adhesive, such as contact paper 65, is disposed in the receptacle 90, between an inner surface of the receptacle and an end of the push pin's handle 95.

In another non-limiting example, the frame plate's back side comprises one or more indentations 103 for one or more connectors (e.g., hook-and-loop fasteners, double-sided adhesives, magnets, etc.). Accordingly, in this example, a connector can be placed in the indentation and the frame plate can be connected to a suitable supporting unit by simply placing the frame plate on the supporting object.

While the indentation can comprise any suitable surface that allows the frame plate to be connected with a connector, in some non-limiting embodiments, the indentations 103 comprises any suitable surface on the frame plate's back side 80 that is disposed proximally enough from the distal-most end 105 (shown in FIG. 3C) of the frame plate's outermost perimeter 110 to allow the back cover (discussed below) to be connected to the frame plate's back side while the connector is disposed in the indentation. By way of non-limiting illustration, FIG. 3C illustrates an embodiment in which in which a connector 111 (e.g., a magnetic strip, a strip of hook-and-loop fastener, etc.) can be disposed on a distal surface 112 of an indentation 103 the frame plate 20, wherein the distance I between the distal surface 112 and the distal most end 105 of the frame plate's outermost perimeter 110 is substantially equal to the thickness of the connector 111.

The display plate 15 and the frame plate 20 can be connected to each other in any suitable manner that allows the two components to be selectively attached to and disconnected from each other. Indeed, in some non-limiting embodiments, the display plate and the frame plate are connected to each other through the use of one or more attachments, such as one or more frictional engagements, adhesives, clamping mechanisms, and/or any other suitable component that allows the display plate to selectively attach to and detach from the frame plate.

Where the attachment that connects the display plate 15 to the frame plate 20 comprises one or more fictional engagements, the frame system 10 can comprise any suitable frictional engagement. Some examples of suitable frictional engagements include, but are not limited to, a clip, a tongue and groove attachment, and any other suitable component that is capable of frictionally holding the frame plate to the display plate.

In some currently preferred embodiments, however, the display plate 15 selectively attaches to and detaches from the frame plate 20 through the use of one or more clips. Where the display plate and the frame plate connect to each other with a clip, the clip can be disposed on either component. In some implementations, FIG. 3C shows the clip 115 extends from the display plate's second side 50. Similarly, where the clip 115 extends from the display plate 15, FIG. 3D shows that, in some embodiments, the frame plate 20 defines an opening 120 that is shaped and sized to receive the clip 115.

Figure 4:
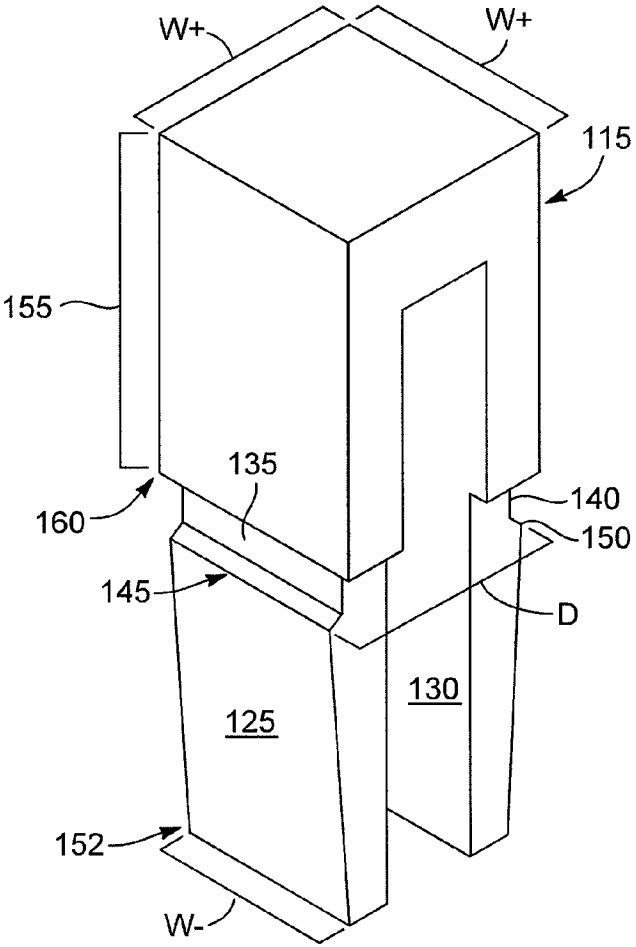
FIG. 4 illustrates a perspective view of a representative embodiment of a clip.

In embodiments in which the display plate 15 and the frame plate 20 are connected with one or more clips 115, the frame and display plates can be connected together with any suitable number of clips, including, without limitation, 1, 2, 3, 4, or more. In some presently preferred embodiments, however, the plates are connected with 2 clips.

Where the display plate 15 and the frame plate 20 are connected to each other with one or more clips, each clip 115 can comprise any suitable characteristic that allows it fulfill its intended purpose. In one non-limiting example, FIG. 4 illustrates an embodiment in which the clip 115 comprises a first tapered arm 125 and a second tapered arm 130, wherein each arm comprises a recess 135 and 140. In this example, when the two arms are relaxed, the distance D between a first ridge 145 on the first arm 125 and a second ridge 150 on the second arm 130 is greater than the corresponding width W in the opening 120 in the frame plate 20 (see FIG. 3D). In addition, FIG. 4 shows the width W− of the distal end 152 of the clip's arms is slightly smaller than the width W of the opening 120 in the frame plate 20 (see FIG. 3D). Accordingly, when the clip's first arm 125 and second 130 arm are forced into the opening 120 so that the first 145 ridge and second 150 ridge move past the opening 120, the clip 115 becomes selectively locked to the frame plate 20. At this point, to remove the display plate from the frame plate, the first and second arms are simply squeezed together to allow the clip to be removed from the opening.

In some non-limiting embodiments, the frame system 10 comprises one or more spacers to maintain a space between the display plate's second side 50 and the frame plate's front side 75. In this manner, the spacer can provide the frame system with a 3-dimentional appearance in which the display plate appears to float away from the frame plate.

Where the frame system 10 comprises one or more spacers, the frame system can comprise any suitable number of spacers, including, but not limited to, 1, 2, 3, 4, 5, or more. Indeed, in some presently preferred embodiments, the frame system comprises 2 spacers to stabilize and separate the display plate from the frame plate.

Where the frame system comprises spacers, the spacers can be disposed on any suitable component that allows the spacers to fulfill their intended purpose. In one non-limiting embodiment, however, FIG. 4 shows that a spacer 155 is disposed on the clip 115.

While the spacer 155 can comprise any suitable characteristic that allows it to function as intended, FIG. 4 shows an embodiment in which the spacer 155 comprises a shoulder 160 that has width W+ that is larger than the width W of the opening 120 in the frame plate 20 (as shown in FIG. 3D) and, thereby, prevents the clip 115 from being inserted into the frame plate 20 past the shoulder 160.

Additionally, where the frame system 10 comprises a spacer 155, the spacer can maintain any suitable distance between the frame plate's front side 75 and the display plate's second side 50. Indeed, in some non-limiting embodiments, the spacer maintains a space that is more than about 5 millimeters (about 0.2 inches), about 1 centimeters (about 0.4 inches), about 2 centimeters (about 0.8 inches), or larger. Similarly, in some non-limiting embodiments, the spacer maintains a space that is less than about 6 centimeters (about 2.4 inches), about 4 centimeters (about 1.6 inches), about 2 centimeters (about 0.8 inches), or less.

Figure 5:
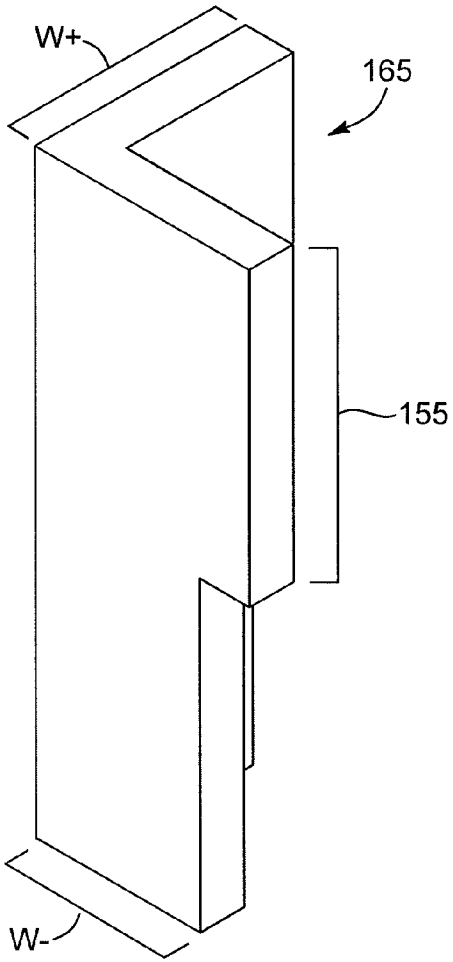
FIG. 5 illustrates a perspective view of a representative embodiment of an alignment member that is configured to hold the display plate square and firm with respect to the frame plate.

In some non-limiting embodiments, the frame system 10 also comprises one or more alignment members that extend between the display plate 15 and the frame plate 20. By way of illustration, FIG. 3C shows a non-limiting embodiment in which at least one alignment member 165 extends from the display plate's second side 50.

Where the frame system comprises one or more alignment members, the alignment members can serve any suitable purpose, including helping to stabilize the display plate on the frame plate. Indeed, the use of one or more alignment members can prevent the display plate from wobbling on the frame plate, while reducing the number of clips needed to stabilize the display plate on the frame plate. For instance, instead, of needing 2, 3, 4, or more clips to stabilize the display plate on the frame plate, the frame system can use 1, 2, 3, 4, or more alignment members to stabilize the system. Indeed, where the display plate 15 comprises 2 alignment members 165 and 2 clips 115, the display plate can be securely aligned with the frame plate while a user can easily separate the two plates by pinching the two clips at the same time.

Where the frame system 10 comprises one or more alignment members 165, the alignment members can have any suitable characteristic that allows them to stabilize the display plate's position with respect to the frame plate 20. In one non-limiting example, each alignment member comprises a pin, a peg, an L-shaped shaft, or any other suitable shape. For instance, FIG. 5 illustrates a non-limiting embodiment in which the alignment member 165 comprises an L-shaped shaft, or a shaft that fits in an L-shaped aperture 170 in the frame plate 20 (as shown in FIG. 3D). In another non-limiting embodiment, FIG. 5 shows the alignment member 165 also comprises a spacer 155.

As previously mentioned, in some non-limiting embodiments, the frame system 10 optionally comprises an aligner 25. The aligner may have any suitable characteristic that allows a user to use the aligner to place a display medium on the display plate in a desired position. In one non-limiting example, the aligner has a flat inner surface (on which the medium can be placed) and one or more raised sides, against which the medium can be aligned. In this example, the inner dimensions of the flat inner surface 168 are slightly larger than the perimeter 62 of the display plate 15 (as shown in FIG. 2D). Accordingly, a display medium can be sandwiched between the aligner and the display plate.

Figure 6B:
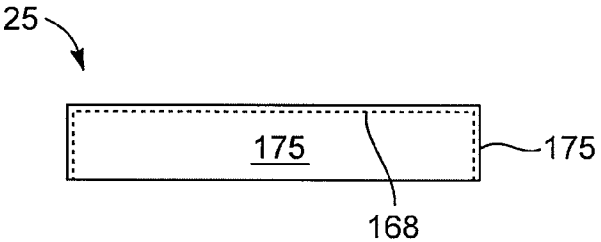
FIG. 6B illustrates a side schematic view of the aligner from FIG. 6A.
Figure 6C:
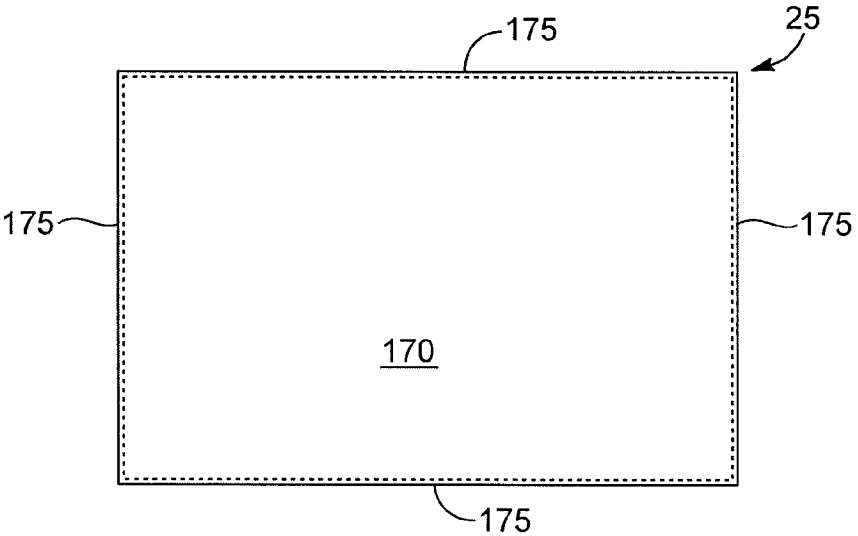
FIG. 6C illustrates a top schematic view of the aligner from FIG. 6A.
Figure 6A:
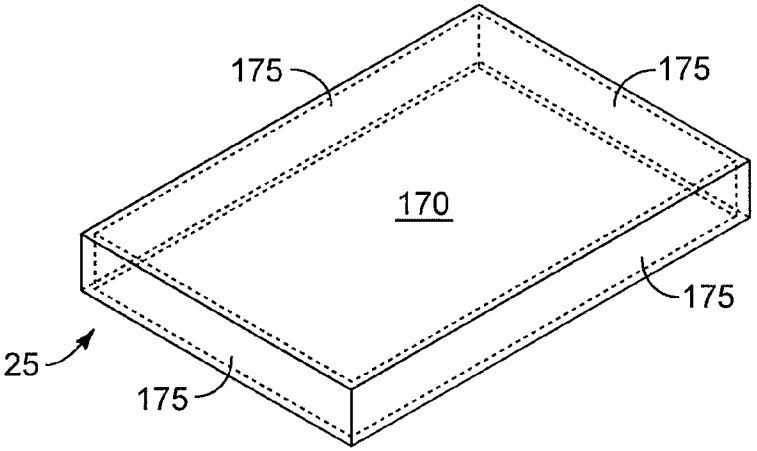
FIG. 6A illustrates a perspective, top view of a representative embodiment of an aligner, wherein the aligner is configured to serve as a receptacle for a display medium to help mount the medium to the display plate, and wherein the aligner also comprises a transparent lens that is optionally used to cover and protect the display medium when the medium is displayed in the frame system.
Figure 7B:
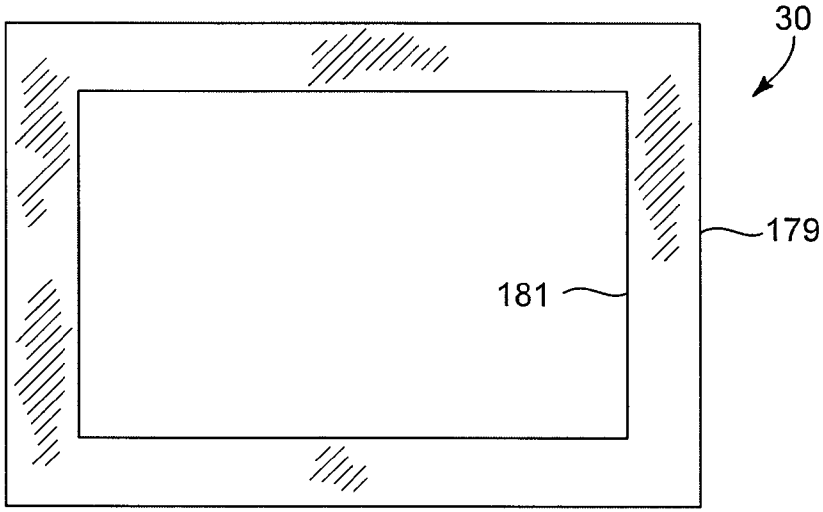
FIG. 7B illustrates a top schematic view of the liner from FIG. 7A.
Figure 7D:
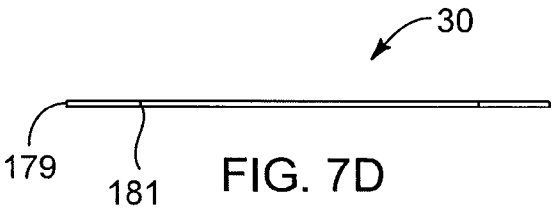
FIG. 7D illustrates a cross-sectional view of the liner from FIG. 7A, cut along line
Figure 7A:
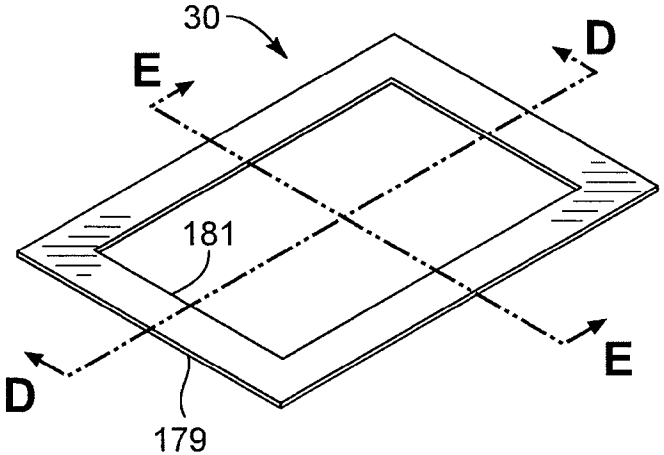
FIG. 7A illustrates a perspective view of a representative embodiment of a liner.
Figure 7C:
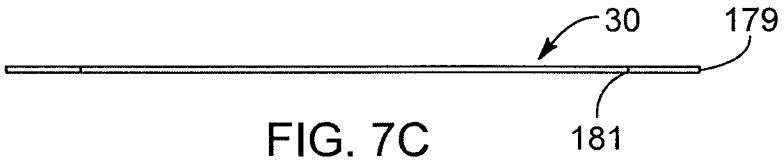
FIG. 7C illustrates a cross-sectional view of the liner from FIG. 7A, cut along line D-D.

In one non-limiting illustration, FIG. 6A (and FIGS. 6B and 6C) shows an embodiment in which the aligner 25 comprises a transparent lens 170 with four raised sides 175. In this embodiment, the medium (not shown) can be placed on the lens' inner surface 168 (shown in FIG. 6B) so that the side of the medium that is meant to be displayed faces out through the transparent lens 170.

Where the display plate 15 comprises contact paper 65, or some other suitable securing mechanism (as previously discussed), the aligner 25 can be used as a jig to guide the display medium into proper alignment with the display plate. Once the display medium is secured to the display plate, the medium can be displayed on the frame system, with or without the aligner, according to the user's desires. For instance, where the aligner is used over the display plate (as a flat plate or as a shadow box), the aligner can protect the display media on or in the display plate. In contrast, in some cases, after the aligner is used to align media on the display plate, the aligner is removed from the display plate and the media is displayed without a protective cover.

As mentioned above and shown in FIGS. 1B and 2C, in some non-limiting embodiments, the frame system 10 comprises a liner 30 that can be disposed between the display plate's second side 50 and the frame plate's front side 75. The liner can be used for any suitable purpose, including improving the aesthetics of the frame system. For instance, the frame system can comprise one or more liners having any suitable desired color, texture, size, mattes, etc. to create a greater appearance of depth, a desired color scheme, and/or a desired accent to the total presentation. In some presently preferred embodiments, the frame system comprises a single liner that has virtually any desired characteristic.

While the liner 30 can have any suitable characteristics, FIGS. 7A through 7D show different views of one non-limiting embodiment in which the liner 30 has an outer perimeter 179 that is larger than the display plate's outer perimeter 62 (shown in FIG. 1A). In another non-limiting embodiment, the liner 30 has an inner perimeter 181 that is smaller than the display plate's outer perimeter 62.

In some non-limiting embodiments, the frame system 10 also comprises a back cover 40. Although the back cover can serve a variety of purposes, in some instances, the back cover connects to the frame plate's back side so as to cover the frame plate's back side and to allow the frame system to be freestanding or to be attached to a supporting object.

The back cover 35 can have any suitable characteristic. Indeed, in one non-limiting embodiment (which is not illustrated), the back cover comprises one or more holes, slots, grooves, hooks, loops, or other holders that are sized and shaped to catch a fastener (such as a nail, a screw, a hook, or any other suitable fastener) that is extending from a supporting object (such as a wall). In some presently preferred embodiments, the holder comprises a conventional hole having a plurality of diameters, wherein a first diameter of the hole is sized to allow a fastener's head to pass there through, and wherein a second diameter is sized to prevent the fastener's head from passing through that portion of the hole. In still another non-limiting embodiment, FIGS. 3A and 3D show the frame plate 20 comprises a "V" shaped aperture 171 having a half-rounded top. In such an embodiment, the user hanging the frame system 10 can locate a fastener (such as a nail) and then allow the frame system to fall into place with respect to the fastener.

Figure 8B:
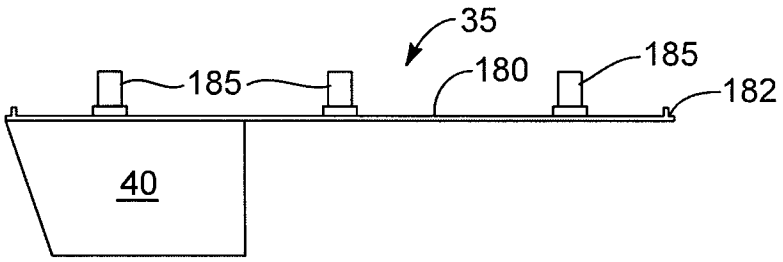
FIG. 8B illustrates a side schematic view of the back cover of FIG. 8A.
Figure 8C:
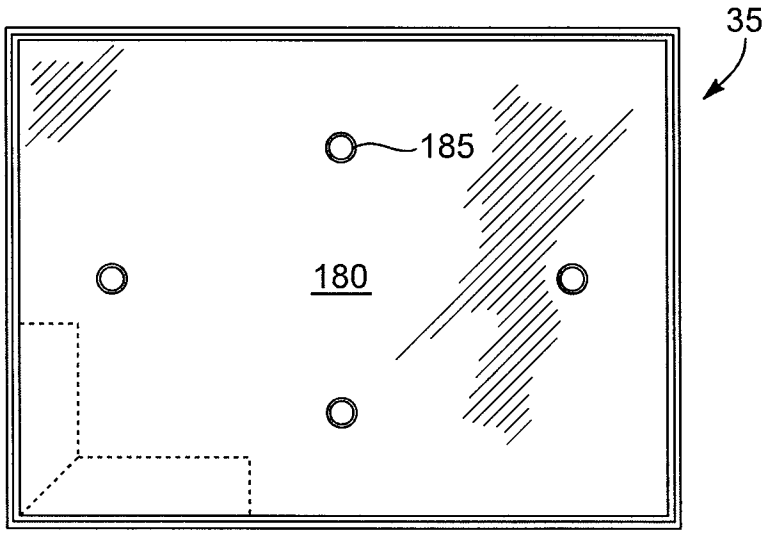
FIG. 8C illustrates a top schematic view of the back cover of FIG. 8A.
Figure 8A:
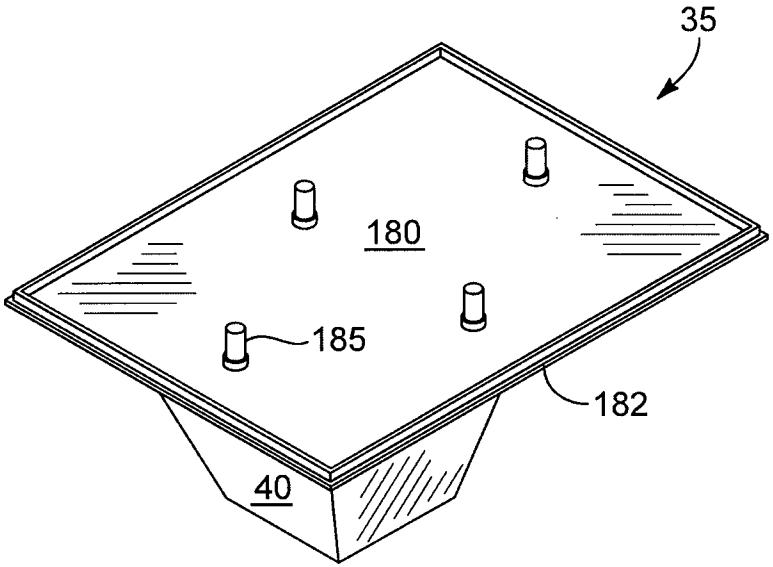
FIG. 8A illustrates a top perspective view of a representative embodiment of a back cover.

In some other non-limiting embodiments, FIGS. 8A through 8C show the back cover 35 comprises a proximal face 180 that is sized and shaped to cover the frame plate's back side 80, a lip 182 that is configured to extend proximally into the frame plate, one or more frame plate fasteners (e.g., process 185) for connecting the back cover 35 to the frame plate 20, and/or one or more legs 40 for supporting the frame system 10.

Where the back cover 35 comprises one or more frame plate fasteners, the frame plate fasteners can comprise any suitable component that allows the back cover to be connected to the frame plate 20. Some non-limiting examples of suitable frame plate fasteners include one or more processes, clips, adhesives, mechanical fasteners (e.g., hook-and-loop fasteners), frictional engagements, and/or any other suitable component. In one non-limiting embodiment, however, FIG. 8A shows the frame plate fastener comprises at least one process 185 that extends proximally from the proximal surface 180 of the back cover 35, and which is sized and shaped to be received within a corresponding push-pin receptacle 90 on the frame cover 90 (shown in FIG. 3C). In such embodiments, the frame plate fastener can be connected to the frame plate in any suitable manner, including, but not limited to, through the use of a frictional engagement that selectively receives and releases the frame plate fastener from the receptacle, an adhesive in the receptacle, and/or any other suitable component that is capable of maintaining the process within the receptacle. In some preferred embodiments, however, FIG. 3C shows the process 185 is retained within the receptacle 90 through the use of an adhesive, such as a contact paper 65.

As mentioned, in some non-limiting embodiments, the back cover 35 comprises one or more legs 40. In such embodiments, the legs allow the frame system to support itself on a flat object, such as a table, a shelf, a cabinet, or any other structure suitable of allowing the frame system to stand thereon.

Where the frame system comprises one or more legs, the legs can have any suitable characteristic. In one non-limiting example, each leg can have any suitable shape. In another non-limiting example, each leg can connect to a distal face 190 of the back cover in any suitable manner, including, without limitation, by being integrally formed with the back cover, by being snapped into slots (not shown) in the back cover 35, by being chemically bonded to the back cover, and/or in any other suitable manner. In some preferred embodiments, however, a single leg is integrally formed with and connected to the back cover 35, as illustrated in FIGS. 8A and 8B.

Figure 9B:
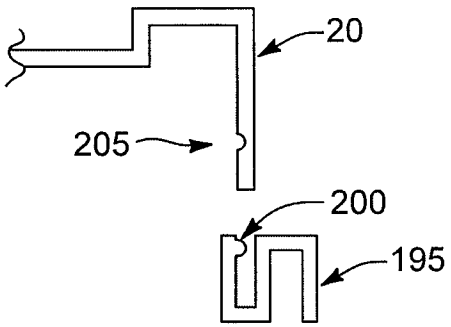
FIG. 9B illustrates a cross-sectional view of a representative embodiment of the frame plate and a representative embodiment of the additional border.
Figure 9A:
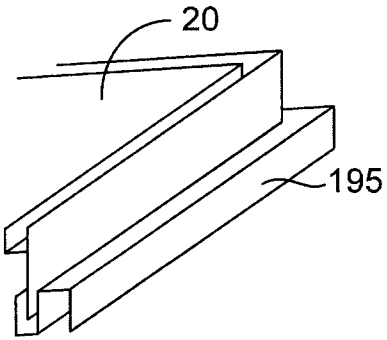
FIG. 9A illustrates perspective view of a portion of a representative embodiment of the frame system comprising a representative embodiment of an additional border.

In addition to the previously mentioned components and characteristics, the frame system 10 can comprise any other suitable component or characteristic. In one non-limiting example, the frame system optionally comprises an additional border that can be used to further decorate and accessorize the frame system for a desired application. While such a border can be disposed in any suitable location, FIG. 9A shows a non-limiting embodiment in which the additional border 195 is disposed around the outermost perimeter 110 of the frame plate 20.

Where the frame system 10 comprises an additional border 195, the border can be connected the frame system in any suitable manner. By way of non-limiting example, the additional border can connect to the frame plate through one or more frictional engagements, adhesives, and/or any other suitable component.

Where the additional border 195 connects to the frame plate 20 through a frictional engagement, the border may be connected through the use of any suitable frictional engagement. By way of illustration, FIG. 9B shows that, in one non-limiting embodiment, the border 195 comprises a projection 200 that frictionally mates with a groove 205 in the frame plate 20.

Figure 9C:
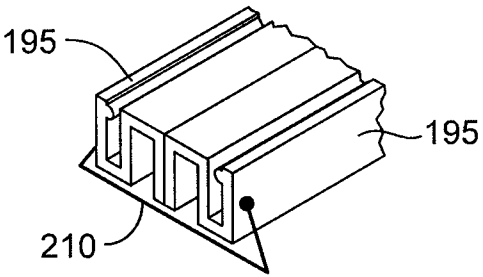
FIG. 9C illustrates a perspective view of a portion of a representative embodiment of two additional boarders connected together with a representative embodiment of a spring clip.

In yet another non-limiting example of an additional component or characteristic, the frame system 10 is optionally adapted to be selectively connected to and disconnected from one or more additional frame systems to form a collage of frame systems. In this manner, a plurality of frame systems can be displayed as one cohesive presentation.

Where multiple frame systems 10 are connected together, the frame systems can be connected to each other in any suitable manner. Some examples of suitable mechanisms for connecting multiple frames systems together include, but are not limited to, the use of one or more adhesives, hook-and-loop fasteners, frictional engagements, mechanical clamps, and the like. Indeed, in some non-limiting embodiments, multiple frame systems are connected together through the use of virtually any suitable mechanical clamp that can releasably connect at least two frame systems together. By way of non-limiting illustration, FIG. 9C illustrates an embodiment in which the mechanical clamp comprises a spring clip 210 that is capable of biasing components from 2 different frame systems together. Specifically, FIG. 9C shows that where 2 frame systems (not shown) each comprise an additional border 195, the borders 195 are connected together through the use of a spring clip 210 that holds the borders 195 in frictional contact with each other.

Figure 10:
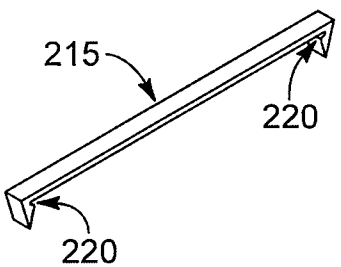
FIG. 10 illustrates a side schematic view of a representative embodiment of a separating bar.

In still another non-limiting example, the frame system 10 comprises one or more separating bars. Generally, the bars may be used to split the display surface 55 of the display plate into a plurality of sections. In this manner, the display plate can be adapted to hold a plurality of media, of one or more sizes. Additionally, where the frame system comprises one or more bars, the bars can be used to create a montage on the display plate. Accordingly, the frame can be further be customized for specific media, applications, users, etc. For instance, the bars can be used to separate the display surface into 2 frames, 3 frames, 4 frames, etc., that are configured for specific media.

Where the frame system comprises one or more bars, the bars can have any characteristic suitable for use with the frame system. By way of non-limiting example, the bars can be about the length of the display plate and/or the frame plate. Additionally, the bars and/or the frame may be adapted to be snapped together and/or to one or more components of the frame system for fast and easy assembly. By way of non-limiting example, FIG. 10 illustrates a non-limiting embodiment in which the bar 215 comprises a plurality of indentations 220 that are sized and shaped to frictionally engage the separating bar 215 to the perimeter 62 of the display plate 20 (not shown in FIG. 10).

The described frame system 10 may be made of any suitable material, including, but not limited to, a plastic, a wood, a metal, a ceramic, a polymer, a composite, and combinations thereof. However, in some preferred embodiments, the frame system is fabricated from a plastic or a polymer.

The frame system can also be made in any suitable manner. Some examples of suitable methods for forming the various components of the frame system include, but are not limited to, extruding, cutting, bending, molding, etching, bonding, fastening, joining, or otherwise shaping the various components.

The various components of the frame system can also have any desired color. Moreover, the various components of the frame system can be interchanged with components of various colors. In this manner, the frame system's color scheme can easily be customized and personalized by the user.

The frame system 10 may be virtually any desired size. Indeed, in some non-limiting embodiments, the frame system's length and/or width is selected from a measurement that is greater than: about 2 centimeters (about 0.8 inches), about 5 centimeters (about 2 inches), or about 10 centimeters (about 4 inches). Similarly, in some non-limiting embodiments, the frame system's length and/or width is selected from a measurement that is less than: about 1.2 meters (about 4 feet), 61 centimeters (about 2 feet), or about 30 centimeters (about 1 foot).

The various components of the frame system (e.g., the display surface 55 of the display plate 15, the outermost perimeter 110 of the frame plate 20, etc.) may also be any suitable shape, including, but not limited to, square, rectangular, circular, elliptical, polygonal, irregular, etc. In one non-limiting example, FIG. 1A shows the display surface 55 of the display plate 15 and the outermost perimeter 110 of the frame plate 20 are each substantially rectangular. While FIG. 1A illustrates an embodiment where the display surface 55 and the outermost perimeter 110 of the frame plate 20 are both substantially rectangular, the two need not be similar in shape. By way of non-limiting example, the outermost perimeter 110 of the frame plate 20 can be substantially square while the display surface 55 of the display plate 15 may be substantially circular.

The described frame system may offer several benefits and advantages. By way of non-limiting example, because the frame system is accessorizable, it can easily be configured and reconfigured multiple times. Moreover, the frame system can be personalized and customized for a variety of media, users, applications, etc. Additionally, because some components of the frame system can be selectively connected to and disconnected from each other through the use of one or more frictional engagements (e.g., clip 115) in some cases, the frame system is able to be accessorized and configured without the use of tools. In fact, in some cases, the frame system requires no tools for assembly and/or mounting. However, in other cases, the frame system may simply require a level to level the frame system, or an adhesive to permanently secure the components in place, if desired.

Thus, the present application discusses systems and methods for providing an accessorizable frame system having a plurality of pieces that selectively connect to and disconnect from each other. Because certain pieces in the frame system can easily be connected to and disconnected from each other, the frame system is easily assembled, customized, and otherwise used to provide an aesthetically pleasing display.

The present invention may be embodied in other specific forms without departing from its spirit or essential characteristics. The described examples and embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An accessorizable frame system comprising:

a frame plate having a front side and a back side, wherein an outer perimeter of the frame plate extends proximally past the frame plate's front side;

a display plate having a first side and a second side, wherein an outermost perimeter of the display plate is smaller than the outer perimeter of the frame plate, and wherein the display plate's first side comprises a substantially flat display surface that is configured to support a piece of display media;

an attachment extending between the frame plate's front side and the display plate's second side, wherein the attachment comprises a frictional engagement that selectively and releasably holds the display plate away from the frame plate, and wherein the attachment is disposed in from the outermost perimeter of the display plate; and an alignment member that extends from the display plate's second side to stabilize the display plate on the frame plate, and wherein the alignment member is configured to fit in an aperture in the frame plate's front side.

2. The frame system of claim 1, wherein the display plate comprises a shadow box having at least one raised edge that extends proximally away from the display surface on the display plate.

3. The frame system of claim 1, further comprising a separator bar that is configured to frictionally engage with the display plate to split the display surface into a plurality of sections.

4. The frame system of claim 1, further comprising a liner that is disposed between the frame plate's front side and the display plate's second side, wherein an outer perimeter of the liner is larger than the outermost perimeter of the display plate.

5. The frame system of claim 1, wherein the back side of the frame plate comprises at least one push-pin receptacle.

6. The frame system of claim 5, further comprising a back cover comprising at least one process that is sized and shaped to fit within the at least one push-pin receptacle.

7. The frame system of claim 1, further comprising an aligner having a transparent lens comprising an inner surface, wherein at least one side of the aligner extends away from the inner surface, and wherein the inner surface of the lens is larger than a display surface on the display plate.

8. The frame system of claim 1, wherein the alignment member comprises a spacer that is sized and shaped to retain a space between the display plate's second side and the frame plate when the display plate is connected to the frame plate.

9. The frame system of claim 1, wherein the frictional engagement comprises:

a clip that extends from the display plate, wherein the clip comprises an arm having a ridge; and an opening in the frame plate's front side is sized and shaped to selectively lock the clip in the opening once the ridge is pushed past the opening.

10. An accessorizable frame system comprising:

a display plate having a first side and a second side, wherein at least one clip extends from the display plate's second side and is disposed in from any perimeter of the second side, and wherein the display plate comprises a spacer that is sized and shaped to retain a space between the display plate's second side and a frame plate when the display plate is connected to the frame plate; and the frame plate having a front side and a back side, wherein an outermost perimeter of the frame plate is larger than a display surface on the display plate, wherein the outermost perimeter of the frame plate is raised proximally past the frame plate's front side, wherein the frame plate's front side comprises at least one opening that is sized and shaped to receive the at least one clip, and wherein the at least one clip is configured to extend through the frame plate's front side, in from the raised outermost perimeter of the frame plate, and to be released from the back side of the frame plate.

11. The frame system of claim 10, further comprising a liner that is disposed between the frame plate's front side and the display plate's second side, wherein an outer perimeter of the liner is larger than the outermost perimeter of the display surface on the display plate.

12. The frame system of claim 10, further comprising at least one alignment member that extends from the display plate's second side to stabilize the display plate with respect to the frame plate, and wherein the alignment member is configured to fit in an aperture in the frame plate's front side.

13. The frame system of claim 10, wherein the frame plate further comprises at least one push-pin receptacle disposed at the frame plate's back side.

14. The frame system of claim 13, further comprising a back cover comprising at least one process that is sized and shaped to fit within the at least one push-pin receptacle.

15. The frame system of claim 10, wherein the display plate comprises a shadow box having at least one raised edge that extends proximally away from the display surface on the display plate.

16. A method for making an accessorizable frame system, the method comprising:

providing a frame plate having a front side and a back side, wherein an outer perimeter of the frame plate extends proximally past the frame plate's front side;

providing a display plate having a first side and a second side, wherein the display plate comprises a substantially flat display surface, wherein an outermost perimeter of the display plate is smaller than the outer perimeter of the frame plate, wherein the display plate comprises an alignment member that extends from the display plate's second, and wherein the alignment member fits in an aperture in the frame plate's front side to stabilize the display plate with respect to the frame plate; and providing an attachment extending from the display plate's second side, wherein the attachment comprises a frictional engagement that is configured to selectively and releasably hold the display plate away from the frame plate, and wherein the attachment is disposed in from the outermost perimeter of the display plate; and attaching the display plate to the frame plate by inserting the alignment member into the aperture in the frame plate's front side and inserting the attachment into a corresponding opening within the frame plate's front side.

17. The method of claim 16, wherein the display plate comprises a shadow box having at least one raised edge that extends proximally away from the display surface on the display plate.

18. The method of claim 16, further comprising providing an aligner having a transparent lens comprising an inner surface, wherein at least one side of the aligner extends away from the lens' inner surface, and wherein inner surface of the lens is larger than a display surface on the display plate.

19. The method of claim 16, further comprising providing at least one alignment member that extends between the frame plate's front side and the display plate's second side.

20. A method for assembling an accessorizable frame, the method comprising:

providing a frame plate having a front side and a back side;

providing a display plate having a first side and a second side, wherein a first perimeter of the display plate's first side is smaller than an outermost perimeter of the frame plate's front side;

applying an adhesive to the first side of the display plate;

providing an attachment extending from the display plate's second side, wherein the attachment is disposed in from an outer edge of the display plate and is configured to selectively and releasably connect the display plate to the first side of the frame plate;

providing an aligner having a transparent lens comprising an inner surface, wherein multiple walls extend away from the lens' inner surface, and wherein the inner surface of the lens is larger than the front side of the display plate;

placing a display item against the inner surface of the lens such that the walls align the display item;

placing the display plate within the aligner such that the adhesive attaches the display item to the first side of the display plate; and connecting the display plate to the frame plate.

* * * * *